US005254303A

United States Patent [19]

Ostertag et al.

[11] Patent Number: 5,254,303

[45] Date of Patent: Oct. 19, 1993

[54] METHOD AND DEVICE FOR MANUFACTURING MOLDED BODIES

[75] Inventors: Karl Ostertag, Erlenbach; Gerhard Ries, Obernburg; Alfons Leeb, Kleinwallstadt, all of Fed. Rep. of Germany

[73] Assignee: Akzo N.V., Netherlands

[21] Appl. No.: 899,933

[22] Filed: Jun. 17, 1992

Related U.S. Application Data

[63] Continuation of Ser. No. 656,557, Feb. 15, 1991, abandoned.

[30] Foreign Application Priority Data

Feb. 16, 1990 [DE] Fed. Rep. of Germany ..... 4004798

[51] Int. Cl.[5] ..... D01D 5/14

[52] U.S. Cl. ..... 264/181; 425/67

[58] Field of Search ..... 264/180, 181, 178 F, 264/199; 425/72.2, 67

[56] References Cited

U.S. PATENT DOCUMENTS

| | | | |
|---|---|---|---|
| 2,289,657 | 5/1938 | Knehe et al. . | |
| 2,510,135 | 6/1950 | Watson et al. . | |
| 3,049,755 | 8/1962 | Aizawa et al. | 425/66 |
| 3,689,620 | 9/1972 | Miyazaki et al. | 264/199 |
| 4,876,040 | 10/1989 | Park et al. | 264/180 |

FOREIGN PATENT DOCUMENTS

| | | | |
|---|---|---|---|
| 555183 | 6/1930 | Fed. Rep. of Germany . | |
| 509294 | 10/1930 | Fed. Rep. of Germany . | |
| 1660187 | 5/1971 | Fed. Rep. of Germany . | |
| 2056872 | 5/1971 | Fed. Rep. of Germany . | |
| 1660188 | 11/1971 | Fed. Rep. of Germany . | |
| 1660144 | 6/1972 | Fed. Rep. of Germany . | |
| 2147078 | 9/1976 | Fed. Rep. of Germany . | |
| 3838053 | 5/1989 | Fed. Rep. of Germany . | |
| 1337249 | 8/1963 | France | 264/180 |
| 47-29927 | 8/1972 | Japan . | |
| 59-228013 | 12/1984 | Japan . | |
| 61-19805 | 1/1986 | Japan . | |

*Primary Examiner*—Jill L. Heitbrink
*Attorney, Agent, or Firm*—Oliff & Berridge

[57] ABSTRACT

In a method and device for shaping thread-forming materials from a homogeneous isotropic or anisotropic, single or multiphase liquid multicomponent system, the liquid multicomponent system is forced through nozzle openings into a liquid which is under pressure. The liquid is moved in the direction of travel in a channel system composed of sections with constant and/or slightly tapering cross sections, and the flow rate of the liquid is increased accordingly.

19 Claims, 3 Drawing Sheets

METHOD AND DEVICE FOR MANUFACTURING MOLDED BODIES

This is a continuation of application Ser. No. 07/656,557 filed Feb. 15, 1991, now abandoned.

TECHNICAL FIELD

The invention relates to a method of shaping bodies such as threads, hollow threads, flat films, or tubular films and the like (e.g., sheets and panels) from thread-forming substances, from a homogeneous isotropic anisotropic, single or multiphase liquid multicomponent system, as well as a device for working the method. For convenience, these bodies will generally be referred to herein as threads.

BACKGROUND

A method of this kind is known from Japanese Published Patent Application No. 61-19,805. Although this publication teaches an increase in the spinning speed in wet-spinning methods to approximately a maximum of 1500 m/min, the quality requirements which must be imposed on textile threads are not met. Thus, the "dry stretch" at a spinning speed of 1500 m/min is only 10%.

SUMMARY OF THE INVENTION

A goal of the present invention is to increase working speeds significantly over those conventionally encountered in the prior art and considerably to improve the quality of the products.

This and other goals are achieved by a method of the type recited above, in which the liquid multicomponent system, according to the invention, is forced through one or more nozzle openings into a liquid which is under pressure and may be heated and/or cooled. The liquid is moved in the direction of travel in a system of channels which is formed of segments with constant and/or slightly tapered cross sections, and the flow rate of the liquid is increased accordingly.

DETAILED DESCRIPTION OF PREFERRED EMBODIMENTS

Figure 1:
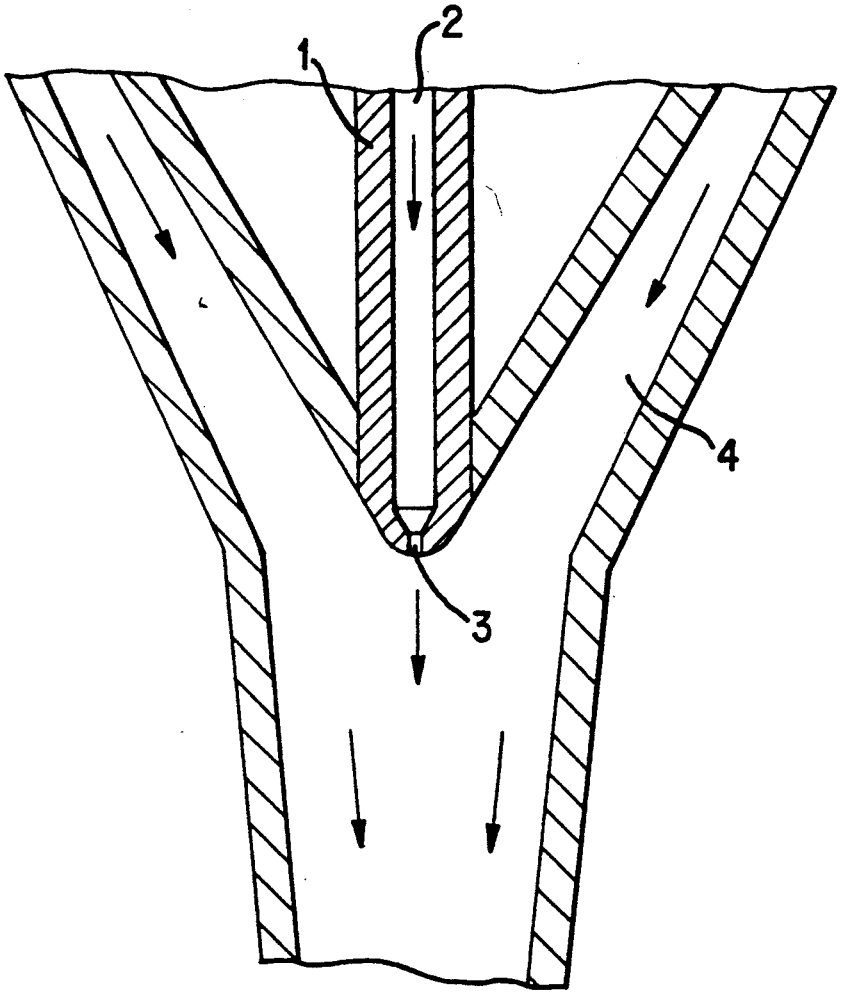
FIGS. 1 and 2 show in simplified schematic form a section through embodiments of the device according to the invention.

In one preferred embodiment of the method, a pressure of 2.5–250 bars is set in the liquid above the nozzle and this pressure is reduced as the liquid passes through the channel system. Preferably the pressure is reduced to atmospheric pressure as it passes through the channel system.

The threads can easily be laid down in a wavy fashion in the method according to the invention by providing a diffuser to reduce the flow rate at the end of the channel system.

The thread-forming substances include cellulose, polyamides, polyesters, polypropylene, polyethylene, PVA, and similar polymers and/or copolymers as well as silicate, aluminate, or similar inorganic thread-forming substances, individually or in mixtures.

Appropriate single-phase systems include solutions of polymers for wet spinning. Suitable multiphase systems include gels like those used for gel spinning. Transitions between single-phase solutions and gels can also be included in the method according to the invention, something which is especially important when membrane structures are to be produced.

Sample solutions for cellulose include cuoxam, xanthogenate, organic solvents such as N-methylmorpholine oxide or dimethylacetamide, N-methylpyrrolidone, etc., possibly with the addition of alkali and/or alkaline earth salts. Formic acid is preferred for polyamides, for example. Dichloroacetic acid or M-cresol are suitable for polyesters. Selection of solvents which may be used in the invention is within the capability of one of ordinary skill in the art who has read this specification.

The fluid moved through the channel system is not supposed to dissolve the thread-forming substances or to change the multicomponent system only slowly to the solid phase. Preferably, possibly cooled and/or heated water is used, which superbly meets these requirements by selecting the temperature, possibly making it different in different parts of the channel system. The liquid can contain a limited quantity of the respective solvent or, in the case of gels, the swelling agent.

The flow conditions in the channel system can be adjusted by one of ordinary skill in the art who has read this specification in such a way that the forces that must be applied to taper the cross section of the molded bodies are applied in a gentle and uniform manner.

The working speeds for wet shaping were formerly limited to several hundred meters per minute. They may be increased by the method according to the invention to several thousand meters per minute.

The narrowing of the cross section can also be continued immediately after leaving the channel system or in subsequent process stages.

The method according to the invention permits shaping thread-forming substances for which no such method that was economically feasible formerly existed. The characteristics of shaped thread-forming substances of the invention are influenced favorably in an unexpected manner.

Thus for example nylon 4 cannot be melt-spun because it has no thermal stability. Known wet-spinning methods are not economical because of their low operating speeds. The method according to the invention allows nylon 4 to be shaped economically into textile threads with formic acid being preferred as the solvent. Both acetone and water are suitable as the liquid in the channel system. The resultant polyamide threads have a moisture uptake at 20° C. comparable to that of cotton. For example, it is 6% at 65% relative humidity and 11% at 90% relative humidity.

Another polyamide for which the method according to the invention can be used particularly advantageously is polyamide 6 T (polyhexamethylene terephthalate). This is shaped for example from a 16% solution in concentrated sulfuric acid in water or dilute sulfuric acid as the liquid in the channel system.

In threads that are melt-spun in the usual fashion, the method according to the invention creates properties that have an advantageous effect during use. Thus, polyamide 6 dissolved in formic acid and polyethylene terephthalate dissolved in dichloroacetic acid can be shaped using the method according to the invention, using water for example as the liquid in the channel system. The products obtained have a certain surface porosity which produces a dull appearance. The threads manufactured according to the invention, without the addition of $TiO_2$, correspond to a conventional thread to which 0.4% $TiO_2$ has been added. The feel is fuller and drier than in conventional products and has none of the soapy feel known for polyamide 6.

According to the invention liquid multicomponent systems rather than melts are used. Flame retardants and similar additives can be mixed more easily into the liquid multicomponent system than is possible in melts.

Gel spinning methods in the past were performed in two stages. Extrusion of the gel into a liquid is followed by a stretching process in a hot gas. The method according to the invention makes it possible to shape gels in a liquid, i.e. a wet-spinning method. A fluid that is miscible with the swelling components of the gel is selected as the liquid to be used in the channel system; this same liquid can also contain a limited quantity of the swelling component to delay hardening. The temperature of the liquid is then kept above the swelling temperature of the gel.

Since according to the invention pressures up to 250 bars are used, for example, polyamide 6,6 can also be shaped from gels with dimethylsulfoxide at temperatures of the liquid in the channel system from 150° to 190° C. to form threads with good characteristics. Water, possibly with small amounts of $DMSO_2$ added, can be used as the liquid in the channel system.

The new method can also be used advantageously to shape bodies from anisotropic liquid-crystalline solutions.

Polyaramides such as polyparaphenylene terephthalamide are usually spun from anisotropic liquid-crystalline solutions through an air gap into a precipitating bath. Because of the premature crystallization, this technology largely impedes orientation in the direction of travel of the threads. Since the shaping of this anisotropic polyaramide solution in the method according to the invention takes place at liquid temperatures in the channel system of more than 130° C., this premature crystallization is suppressed and the mechanical properties of the aramide fiber are considerably increased by improving the transveres strength.

Cellulose can be shaped in warm water by the xanthogenate method, so that instead of an acid bath with approximately 15% sulfuric acid, only very dilute acids are needed for rinsing, reducing the environmental burden imposed by viscose factories.

The fibrillation of the threads which is observed during the regeneration of cellulose from solutions in N-alkyl-tert. aminoxides, such as N-methylmorpholine oxide for example, is avoided in the method according to the invention by delaying crystallization.

The shaping of polymer mixtures of liquid multicomponent systems is also possible without limitation, provided the polymer mixtures form stable solutions or gels. One example of this is a mixture of 70% polyamide-6 and 30% cellulose-2-acetate in a DMAC/LiCl solution.

If membranes or porous bodies are produced by the method according to the invention, skin formation is eliminated and the resultant products have open surfaces. This is especially true for porous molded bodies which are produced by thermally induced phase separation from polymer solutions which break down in liquid form.

The invention will now be described in greater detail with reference to the following non-limiting examples.

EXAMPLES 1-5

A cellulose-cuoxam solution of the usual composition (approximately 10% cellulose, 7% $NH_3$, 3% Cu) is fed through a spinning pump following deaeration and filtration to a spinneret, which is mounted in a channel system filled with water. In the vicinity of the spinneret, the water is under pressure and at a temperature of 45° C. The water flows together with the forming thread structure through the channel system. The pressure decreases to atmospheric pressure along the system.

The dimensions of the channel system are tabulated individually along with the process parameters. The channel system ends at the circumference of the drum of a centrifuge into which the thread that is formed is laid. The thread is then washed to remove the copper and may be aftertreated in the centrifuge.

Further information on the test parameters and the product data obtained are listed in Tables 1 to 3.

TABLE 1

| Channel System 1 (compsed of 16 sections) | | | |
|---|---|---|---|
| | | Diameter (mm) | |
| Section | Length (mm) | Beginning | End |
| 1 | 180 | 30 | 30 |
| 2 | 150 | 30 | 30 |
| 3 | 500 | 30 | 20 |
| 4 | 170 | 20 | 20 |
| 5 | 200 | 20 | 16 |
| 6 | 200 | 16 | 16 |
| 7 | 200 | 16 | 12 |
| 8 | 100 | 12 | 10 |
| 9 | 100 | 10 | 8 |
| 10 | 100 | 8 | 6 |
| 11 | 75 | 6 | 4.5 |
| 12 | 50 | 4.5 | 3.5 |
| 13 | 50 | 3.5 | 2.5 |
| 14 | 25 | 2.5 | 2.0 |
| 15 | 30 | 2.0 | 1.4 |
| 16 | 20 | 1.4 | 1.2 |
| Total Length | 2,150 | | |

TABLE 2

| Channel System 2 (composed of 4 sections) Quantity of Liquid (l/h) 150 | | | | | |
|---|---|---|---|---|---|
| | Length | Diameter (mm) | | Speed (m/min) | |
| Section | (mm) | Beginning | End | Beginning | End |
| 1 | 180 | 36 | 15 | 2.5 | 14.1 |
| 2 | 230 | 15 | 15 | 14.1 | 14.1 |
| 3 | 20 | 15 | 6 | 14.1 | 88.0 |
| 4 | 30 | 6 | 3 | 88.0 | 352.0 |
| Total Length | 460 | | | Output (m/min) 600 | |

TABLE 3

| Examples | 1 | 2 | 3 | 4 |
|---|---|---|---|---|
| Channel System | 1 | 1 | 1 | 2 |
| Pressure (bars) | 75 | 78 | 97 | 5.4 |
| Beginning: $V_{bath}$ (m/min) | 1.9 | 1.9 | 2.4 | 2.5 |
| Beginning: $V_{thread}$ (m/min) | 3.3 | 4.4 | 3.6 | 0.7 |
| End: $V_{bath}$ (m/min) | 1200 | 1200 | 2200 | 350 |
| End: $V_{thread}$ (m/min) | 1500 | 2000 | 2200 | 600 |
| Strength (cN/tex) | 12 | 14 | 16 | 16 |
| Stretch (%) | 21 | 20 | 18 | 24 |
| Titer (dtex) | 1.2 | 1.2 | 0.9 | 1.5 |
| Spinneret Diameter (mm) | 0.75 | 0.75 | 0.75 | 1.2 |

The invention will now be described in greater detail with reference to the drawing.

In the figures, the flow direction of the thread-forming liquid multicomponent system and the liquid are indicated by arrows. The devices for conveying, processing, and pressing the thread-forming liquid multicomponent system through the spinneret openings, such as pumps, vents, filters, etc., the devices for adding and removing the liquid to and from the channel system and for creating the desired liquid pressure in the channel system, as well as the devices for laying down or receiving the molded body, for example a winding device or a centrifuge to lay down thread-shaped molded bodies are generally known to the individual skilled in the art.

FIG. 1 shows the area in which a nozzle 1 terminates with nozzle channel 2 tapering at the end and nozzle opening 3 in the channel system 4, i.e. in the liquid. Channel system 4 is ring- or funnel-shaped above nozzle opening 3 and made tubular below nozzle opening 3. The facts that channel system 4 starts above spinneret opening 3 and the liquid is also supplied above nozzle opening 3 to channel system 4 means that the thread-forming material is squeezed out of nozzle opening 3 into the liquid with liquid flow at full strength. Channel system 4 is designed so that in the vicinity of nozzle opening 3 any desired pressure can be set; in other words it is closed up to the liquid feed in the upper area and open at the exit end for the liquid and the molded body. If desired, nozzle 1 can also be surrounded by one or more heating and/or cooling jackets. The same applies to channel system 4. This makes it possible to operate with different temperatures in the liquid throughout the channel system. As shown in FIG. 1, channel system 4 already has, directly below nozzle opening 3, a cross section that tapers slightly in the flow direction, which ensures that the rate of flow of the liquid increases accordingly and the static liquid pressure decreases accordingly.

Figure 2:
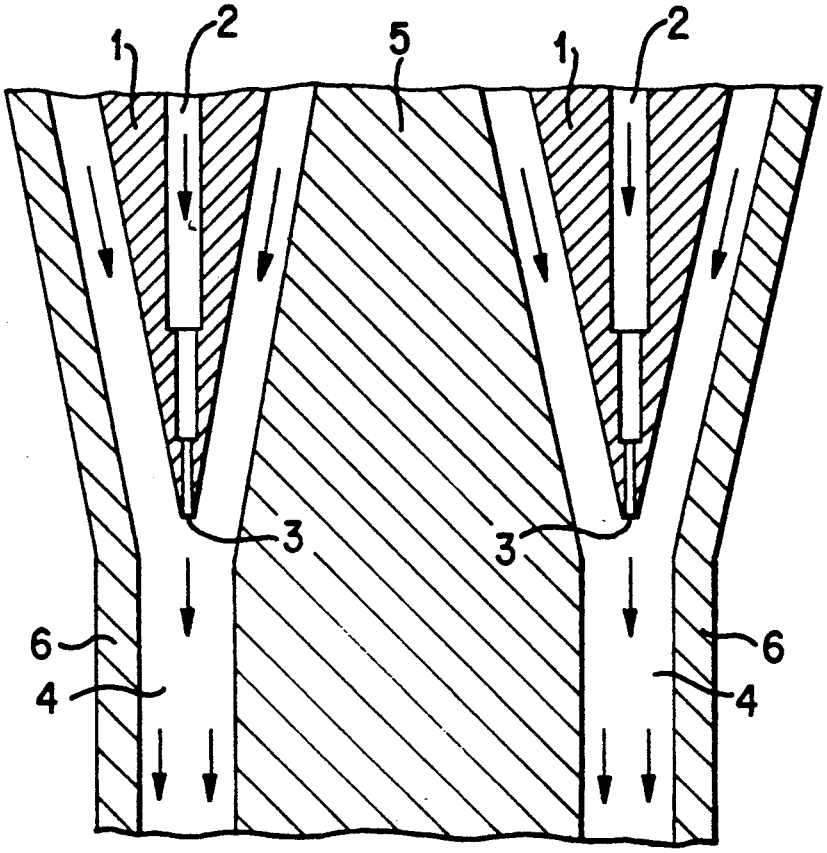

FIG. 2 shows two nozzles 1 out of a plurality of nozzles uniformly distributed around a circle, each having a nozzle channel 2 that tapers in stages and a nozzle opening 3. Channel system 4 in this embodiment is made annular below nozzle openings 3, this being accomplished by providing a core 5 which is suspended so that it floats and centers itself in tube 6. Core 5 preferably extends over the entire length of channel system 4. It may end before the end of channel system 4, so that the section of channel system 4 which is not filled by core 5 is therefore made tubular. In this embodiment as well, channel system 4 consists of segments with constant and/or slightly tapered cross sections. This can be achieved by an appropriate design of tube 6 and/or core 5. Otherwise, the description of the embodiment shown in FIG. 1 applies here as well.

It is particularly advantageous when the change in cross section of the channel system takes place constantly (in other words not abruptly (non-constantly)) in such a way that the ratio of the difference in diameter over a channel length L to a channel length L will be 1:50 (0.02) or less if possible. Nozzle 1 is preferably made in the form of a hollow needle in the vicinity of nozzle opening 3. To make hollow threads, they can be otherwise designed essentially as is usual for this purpose and arranged as shown in FIGS. 1 and 2.

Figure 3:
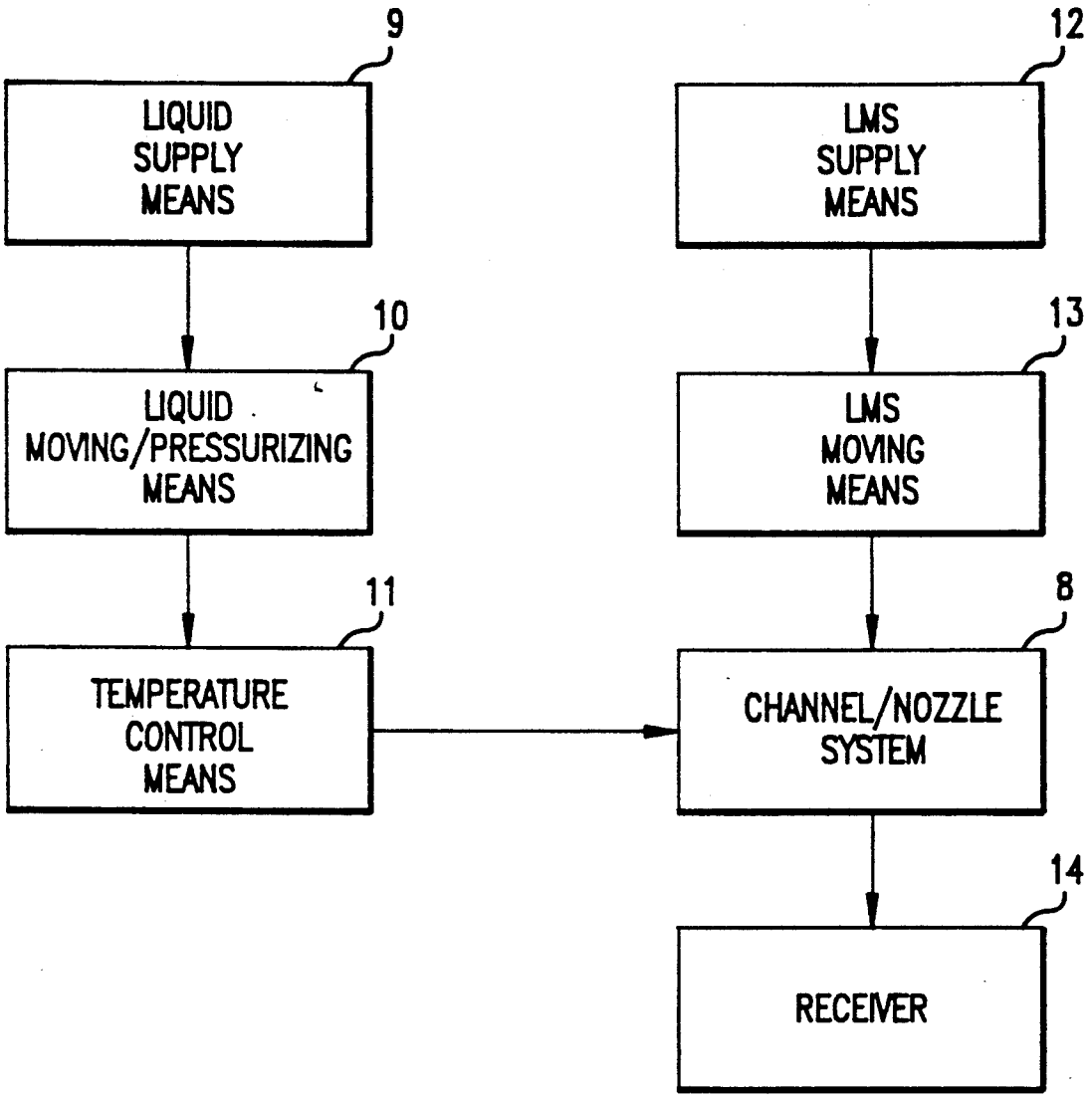
FIG. 3 shows a schematic view of a simplified embodiment of the invention.

FIG. 3 schematically shows a simplified embodiment of the invention. Channel/nozzle system 8 corresponds, for example, to the apparatus shown in FIG. 1. Liquid is supplied to the channel system in channel/nozzle system 8 through liquid supply means 9 for supplying liquid to the channel system, liquid moving/pressurizing means 10 such as a pump for moving and pressurizing the liquid in the channel system, and optional temperature control means 11 such as a heater or cooler for modifying the temperature of the liquid in the channel system (this may also or alternatively be located in the channel/nozzle system 8). The liquid multicomponent system (LMS) is supplied to the nozzle(s) in the channel/nozzle system 8 through LMS supply means 12 and LMS moving means 13 for forcing the LMS through the nozzle(s) in channel/nozzle system 8. The body produced in the device is received or laid down in receiver 14, and the liquid is discarded or, preferably, recycled.

What is claimed is:

1. A method for shaping bodies from threadforming substances, said threadforming substances comprising a homogeneous liquid multicomponent system, wherein the liquid multicomponent system is forced through at least one nozzle opening into a pressurized liquid, which is at a pressure greater than atmospheric pressure, the pressurized liquid and the liquid multicomponent system are moved in the direction of travel in an elongated tapered channel system composed of sections, each section having a constant or slightly tapering cross section, and the flow rate of the pressurized liquid is increased as a function of said tapering whereby the flow rate of the pressurized liquid at an output end of the channel system is increased to at least 350 m/min.

2. A method according to claim 1, wherein said pressure is 2.5 to 250 bars in the pressurized liquid above the nozzle and this pressure is decreased as the pressurized liquid passes through the channel system.

3. A method according to claim 1, wherein the pressure is reduced to atmospheric pressure as the pressurized liquid passes through the channel system.

4. A method according to claim 1, wherein a flow rate of the pressurized liquid is reduced in a diffuser at an output end of the channel system.

5. A method according to claim 1, wherein said bodies are formed in a shape selected from the group consisting of threads, hollow threads, flat films and tubular films.

6. A method according to claim 1, wherein said liquid multicomponent system is isotropic.

7. A method according to claim 1, wherein said liquid multicomponent system is anisotropic.

8. A method according to claim 1, wherein said liquid multicomponent system is a single phase system.

9. A method according to claim 1, wherein said liquid multicomponent system is a multiphase system.

10. A method according to claim 1, wherein said pressurized liquid is heated above ambient temperature.

11. The method according to claim 10, wherein the pressurized liquid is heated to a temperature of at least 130° C.

12. The method according to claim 10, wherein the pressurized liquid is heated to a temperature ranging from about 150° C. to about 190° C.

13. A method according to claim 1, wherein said pressurized liquid is cooled below ambient temperature.

14. The method according to claim 1, wherein the elongated tapered channel system is comprised of more than two sections.

15. The method according to claim 14, wherein a plurality of said sections have a slightly tapering cross section.

16. The method according to claim 1, wherein the elongated tapered channel system is comprised of at least four sections.

17. The method according to claim 16, wherein the elongated tapered channel system is comprised of not more than sixteen sections.

18. The method according to claim 1, wherein the flow rate of the pressurized liquid at the output end of the channel system is at least 1200 m/min.

19. The method according to claim 1, wherein the flow rate of the pressurized liquid at the output end of the channel system is at least 2200 m/min.

* * * * *